US008979661B2

(12) United States Patent
Green

(10) Patent No.: US 8,979,661 B2
(45) Date of Patent: Mar. 17, 2015

(54) INFLATABLE STAIRCASE SLIDE

(71) Applicant: Ryan Green, San Diego, CA (US)

(72) Inventor: Ryan Green, San Diego, CA (US)

( * ) Notice: Subject to any disclaimer, the term of this patent is extended or adjusted under 35 U.S.C. 154(b) by 265 days.

(21) Appl. No.: 13/842,476

(22) Filed: Mar. 15, 2013

(65) Prior Publication Data

US 2014/0302940 A1 Oct. 9, 2014

(51) Int. Cl.
*A63G 21/00* (2006.01)
*A63G 21/02* (2006.01)

(52) U.S. Cl.
CPC ..... *A63G 21/02* (2013.01)
USPC ..... 472/116

(58) Field of Classification Search
CPC ..... A63G 21/00
See application file for complete search history.

(56) References Cited

U.S. PATENT DOCUMENTS

| | | | | |
|---|---|---|---|---|
| D190,125 | S | 4/1961 | Ahrens | |
| 3,743,281 | A | 7/1973 | Gimbel | |
| 3,993,275 | A | 11/1976 | Lucas | |
| 4,813,663 | A | 3/1989 | Rice | |
| 4,943,048 | A | 7/1990 | Hentges | |
| D328,326 | S | 7/1992 | Kuan | |
| 5,197,924 | A | 3/1993 | Gerrels | |
| D340,965 | S | 11/1993 | Lee | |
| 5,427,574 | A | 6/1995 | Donnelly-Weide | |
| D362,291 | S | 9/1995 | Franco | |
| D460,141 | S | 7/2002 | Gourchounian | |
| D472,292 | S | 3/2003 | Peterson | |
| D556,287 | S | 11/2007 | Robinson et al. | |
| D556,288 | S | 11/2007 | Robinson et al. | |
| D557,368 | S | 12/2007 | Berenson | |
| D557,369 | S | 12/2007 | Robinson | |
| 7,494,419 | B2 | 2/2009 | Katz et al. | |
| D597,163 | S | 7/2009 | Boulton et al. | |
| D597,624 | S | 8/2009 | Boulton et al. | |
| 7,789,761 | B1 * | 9/2010 | Lumsden | 472/116 |
| 2012/0135813 | A1 * | 5/2012 | Parkey | 472/116 |

* cited by examiner

*Primary Examiner* — Michael Dennis
(74) *Attorney, Agent, or Firm* — ARC IP Law, PC; Joseph J. Mayo

(57) ABSTRACT

At least one embodiment of the invention describes an inflatable staircase slide assembly that engages with staircases and side rails, and includes an inflatable tubular half-pipe slide member, a compressible support layer, engagement points, ties, at least two elongate straps and at least one blow-up valve. The inflatable tubular half-pipe slide member is placed over the staircase and includes a top portion, a bottom portion, an elongated dipped surface and two sidewalls extending lengthwise from the top portion to bottom portion. The plurality of engagements points are located on each elongate strap of each sidewall, and are coupled to the ties allowing a user to tie the inflatable tubular half-pipe slide member to the side rails at multiple locations for added safety and security. In addition, the compressible support layer is saw-toothed shaped and may be inflatable, padded, or a combination of both.

18 Claims, 4 Drawing Sheets

INFLATABLE STAIRCASE SLIDE

BACKGROUND OF THE INVENTION

1. Field of the Invention

One or more embodiments of the invention are related to slides, specifically tubular inflatable staircase slides for indoor and outdoor use. More particularly, but not by way of limitation, one or more embodiments of the invention describe an inflatable staircase slide with a plurality of engagement points on a side strap on a first sidewall of two sidewalls to couple the inflatable staircase slide to side rails.

2. Description of the Related Art

Generally, recreational slides are located outdoors for play. Many slides have been used indoors using solid slides attached to stairways in a non-portable manner. Most often, the slides are non-inflatable and rest on top of a stairway, or the side of the stairway. Inflatable slides are often found outdoors or used during emergency evacuations. Traditional indoor slides are structured to fit rigidly on top of a stairway with a direct engagement. Many different indoor slides have been dimensioned to specifically accommodate to a specific number of steps. Traditional indoor stairway slides are most often assembled once and unlikely be disassembled thereafter for transportation and/or adjustment.

For example, U.S. Pat. No. 7,789,761 to Lumsden, entitled "Recreational Stairway Slide", discloses an indoor slide attachable to a stairway for play. The recreational stairway slide has an anchored pad at the top of the stairway, an inflatable slide portion and inflatable based formed from tubular sections with each section sized to fit on each stair. Lumsden, however, appears to lack any teaching of a compressible support layer with a saw-toothed configured to engage the stairway steps using at least one tooth. In addition, Lumsden appears to lack any disclosure of a plurality of engagement points on an elongated strap on a sidewall of two sidewalls used to attach the inflatable stairway slide to the staircase side rails.

U.S. Pat. No. 3,743,281 to Gimbel entitled "Play Slide" discloses a play slide configured to be positions on a stairway. The slide is a solid non-inflatable or compressible slide positioned on the stairs in a resting engagement.

U.S. Pat. No. 5,197,924 to Gerrels entitled "Toy Stairway Slide Apparatus" discloses a non-inflatable slide apparatus to be mounted on a stairway using pivotal interconnections. The pivotal interconnections are of various block components to ensure elevated slide sections remain in place.

Traditionally, stairway slides are not equipped and structured to be portable and capable of being transported and used indoors and outdoors. Furthermore, traditional slides are not implemented with side straps that enable a user to tie the slide to side rails of a staircase using engagement points on the side strap. In addition, traditional slides are not equipped with a compressible support layer with a saw-tooth configuration, wherein more than one tooth of the plurality of teeth engage each step of the stairway. In addition, traditional stairway slides are not configured to enable a lack of direct support between stairs to provide a braking effect to the user when sliding down the slide. In addition, traditional stairway slides are not configured to enable multiple slides to attach and detach to a top of the slide or a bottom of the slide in order to lengthen the slide to accommodate to various numbers of steps on a stairway.

For at least the limitations described above there are no known inflatable slide assemblies that are configured as portable and inflatable slides to enable a user to transport the slide for indoor and outdoor use. In addition, for at least the limitations described above, there are no known inflatable slide assemblies that enable a user to coupled the slide assembly to side rails of a stairway using engagement points on a lengthened side strap on a sidewall of the inflatable slide. In addition, for at least the limitations described above, there are no known inflatable slide assemblies that enable a user attach and detach multiple additional slide assemblies using connectors on a top portion of the slide and bottom portion of the slide to increase the length of the slide and accommodate different types of staircases with different number of steps.

BRIEF SUMMARY OF THE INVENTION

One or more embodiments described in the specification are related to inflatable slide assemblies that engage with staircases and side rails, with each staircase having a length and a width. In one or more embodiments, an inflatable slide assembly contains an inflatable tubular half-pipe slide member, a compressible support layer underlying the inflatable tubular half-pipe slide member placed over the staircase to engage the staircase, a plurality of engagement points, and at least one blow-up valve. According to one or more embodiments, the inflatable tubular half-pipe slide member is placed over the staircase and includes a top portion and a bottom portion. In addition, in one or more embodiments inflatable tubular half-pipe slide member includes an elongated dipped surface with a distal edge on the top portion, a proximal edge on the bottom portion, and a tubular intermediate section extending lengthwise between the distal edge and the proximal edge across the length of the staircase. Furthermore, according to at least one embodiment, the inflatable tubular half-pipe slide member includes two sidewalls extending lengthwise from the distal edge on the top portion to the proximal edge on the bottom portion and is oriented on either side of the elongated dipped surface. With such a configuration, each of the two sidewalls rises above the elongated dipped surface.

By way of one or more embodiments, the inflatable tubular half-pipe slide member and the compressible support layer are a single element or two separate elements. In at least one embodiment of the invention, the plurality of engagement points are provided on a first sidewall of the two sidewalls in order to attach the inflatable tubular half-pipe slide member to the side rails. Furthermore, according to one or more embodiments, the at least one blow-up valve is oriented on the inflatable tubular half-pipe slide member and/or the compressible support layer, to allow a user to inflate and deflate the inflatable tubular half-pipe slide member and the compressible support layer. In one or more embodiments, one blow-up valve is included to inflate and deflate both the inflatable tubular half-pipe slide member and the compressible support layer, or separate blow-up valves for each of the inflatable tubular half-pipe slide member and the compressible support layer. As such, the inflatable slide assembly is easily transported from one location to another, such as from indoors to outdoors and vice versa.

According to at least one embodiment of the invention, the compressible support layer is saw-toothed shaped with a plurality of teeth, with each tooth of the plurality of teeth having a horizontal width and a vertical length. Using the plurality of teeth, the support layer is able to engage the staircase at each step of the staircase. In one or more embodiments, each horizontal width of each of the plurality of teeth is shorter than each step of the staircase, such that at least one tooth of the plurality of teeth engages the staircase at each step. In one embodiment, more than one tooth of the plurality of teeth engages each step, such that for example two, three, or more teeth engage a single step of the plurality of steps of the staircase.

One or more embodiments of the invention include at least one elongate strap provided on each sidewall of the two sidewalls extending between the distal edge and the proximal edge of the inflatable tubular half-pipe slide member. In at least one embodiment, each engagement point of the plurality of engagement points is located on each elongate strap. By way one or more embodiments, each engagement point on at least one of the straps contains a plurality of ties allowing a user to tie the inflatable tubular half-pipe slide member to the side rails at multiple locations for added safety and security.

According to one or more embodiments of the invention, the inflatable tubular half-pipe slide member includes a plurality of connectors on each of the two sidewalls used to couple the inflatable slide assembly to one or more additional inflatable slide assemblies. The connectors are provided on one or more of the top portion and the bottom portion of the inflatable tubular half-pipe slide member. As such, multiple inflatable slide assemblies can be connected to one another to increase the total length of the slide and accommodate different types of staircases with different number of steps. In at least one embodiment, the connectors are interchangeable and replaceable to hold different slide assemblies of different shapes and sizes. Using the one or more connectors, a user is able to use the inflatable slide assembly at different locations and different staircases by inflating and deflating the assembly, as well as connecting and disconnecting multiple inflatable slide assemblies from either or both of the top portion of the assembly and the bottom portion of the assembly depending on the user's needs.

At least one embodiment of the invention includes at least one coupling element at the bottom portion and/or the top portion of the inflatable tubular half-pipe slide member in order to provide a horizontal displacement to the inflatable slide assembly with respect to the staircase. According to one or more embodiments, the at least one coupling element is interchangeable in order to accommodate to different staircase surfaces. For example, different coupling elements may be used for a wood surfaced staircase and a carpeted staircase surface.

One or more embodiments may optionally include a landing support extension provided at the bottom portion of the inflatable tubular half-pipe slide member. In at least one embodiment, the landing support extension angles away from the inflatable tubular half-pipe slide member. By way of one or more embodiments, the landing support extension includes extension couplers allowing a user to attach and detach the landing support extension to different inflatable slide assemblies, for example when multiple inflatable slide assemblies are connected to one another using the connectors as explained above.

In one or more embodiments, to provide for better engagement between the inflatable staircase slide assembly and the staircase, the compressible support layer includes a friction element provided on alternating teeth of the plurality of teeth in order to engage with alternating steps of the staircase. According to at least one embodiment of the invention, the friction element may be implemented with one or more of a hook and loop material such as VELCRO® and rubber.

By way of one or more embodiments, for better engagement between the inflatable staircase slide assembly and the staircase, the inflatable slide assembly may include at least one suction cup or "sucker". In at least one embodiment, the at least one sucker is provided on each horizontal width of the plurality of teeth, on each vertical length of the plurality of teeth, at the bottom portion of the inflatable tubular half-pipe slide member, at the top portion of the inflatable tubular half-pipe slide member or any combination thereof.

According to at least one embodiment of the invention, the inflatable staircase slide assembly includes a width extending between the two sidewalls of the inflatable tubular half-pipe slide member, such that the width is less than the width of the whole staircase. This enables a space to be provided around a second sidewall of the two sidewalls, such that only one sidewall of the two sidewalls engages the side rails at a time. This allows for users to use the staircase via the space provided around the second sidewall and use the inflatable staircase slide assembly located beside the space.

In one or more embodiments, the compressible support layer is made of a material selected from rubber, foam, sponge or any combination thereof. Furthermore, in one or more embodiments, the inflatable tubular half-pipe slide member may entirely or partially contain vinyl.

By way of one or more embodiments of the invention, the inflatable slide assembly is a portable assembly allowing a user to transport the assembly. For example, in at least one embodiment, the user is able to transport the assembly using the engagement points.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

An inflatable slide assembly for engagement with a staircase and side rails will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
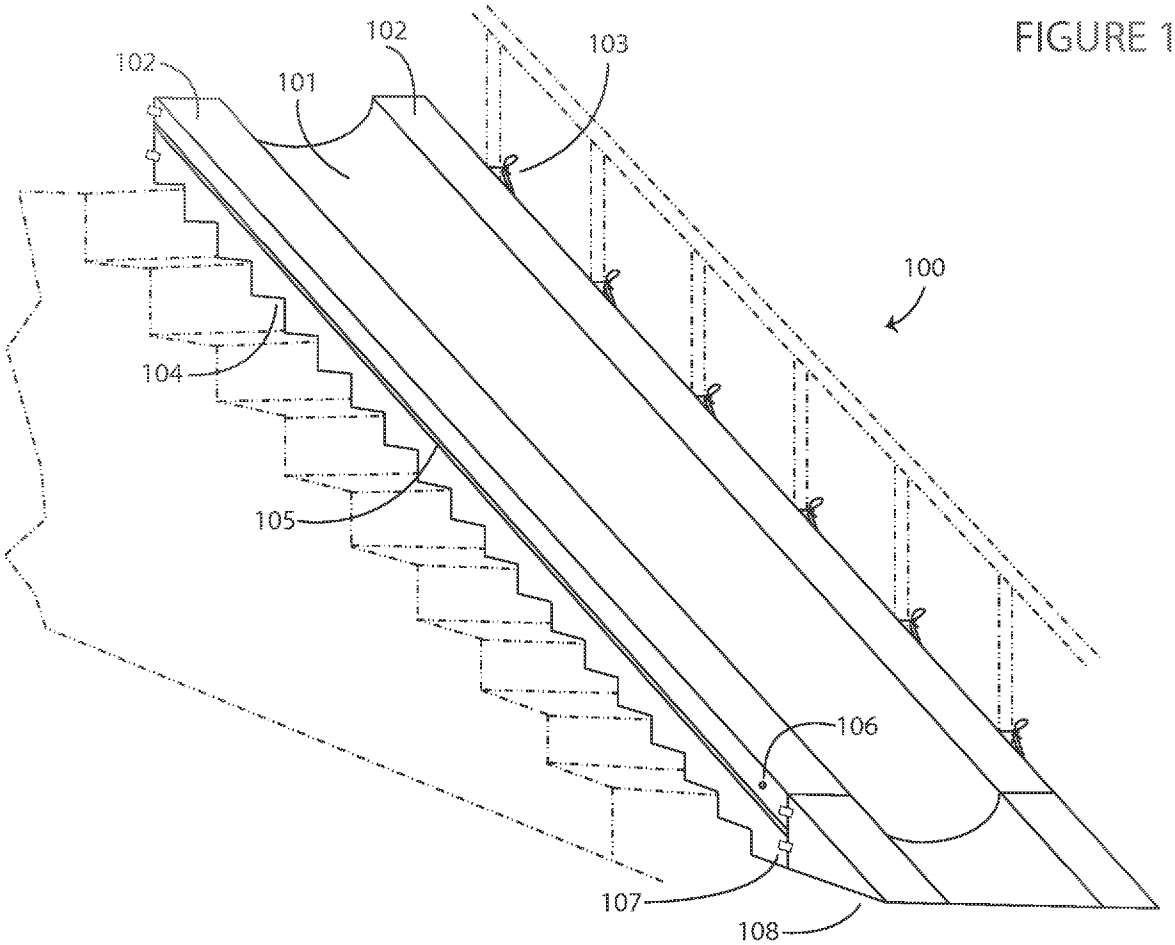
FIG. 1 shows a schematic overall diagram of the inflatable staircase slide assembly and inventive system according to one or more embodiments of the invention.

FIG. 1 illustrates a schematic overall diagram of the inflatable staircase slide assembly and inventive system thereof. Specifically, FIG. 1 depicts an inflatable slide assembly 100 that engages with staircases and side rails, with each staircase having a length and a width. In one or more embodiments, an inflatable slide assembly contains an inflatable tubular half-pipe slide member (shown in FIG. 1 as the combination of elements 101 and 102) and a compressible support layer 104 underlying the inflatable tubular half-pipe slide member placed over the staircase to engage the staircase. The compressible support layer 104 may be implemented as an inflatable support layer or a non-inflatable padded support layer. In addition, the compressible support layer 104 may be partially a non-inflatable padded support layer, and partially inflatable.

As shown in FIG. 1, and according to one or more embodiments, the inflatable tubular half-pipe slide member is placed over the staircase and includes a top portion and a bottom portion. In addition, in one or more embodiments the inflatable tubular half-pipe slide member includes an elongated dipped surface 101 with a distal edge on the top portion, a proximal edge on the bottom portion, and a tubular intermediate section extending lengthwise between the distal edge and the proximal edge across the length of the staircase. Furthermore, according to at least one embodiment, the inflatable tubular half-pipe slide member includes two sidewalls 102 extending lengthwise from the distal edge on the top portion to the proximal edge on the bottom portion and are oriented on either side of the elongated dipped surface 101. With such a configuration, each of the two sidewalls 102 rise above the elongated dipped surface 101. By way of one or more embodiments, the inflatable tubular half-pipe slide member and the compressible support layer 104 are a single element or two separate elements.

FIG. 1 also illustrates the inflatable staircase slide assembly as containing ties 103, used with a plurality of engagement points (shown in FIG. 3), an elongate strap 105, which may be implemented as ties, or couple with ties or other connective elements and/or may be utilized to carry the apparatus, for example when elongate strap 105 is attached at discrete points along the apparatus to provide non-connected portions configured to enable a hand to encircle a portion of the elongate strap. The elongate strap 105 may be provided on each sidewall of the two sidewalls. In addition, at least one embodiment of the apparatus includes at least one blow-up valve 106, connectors 107 and an optional landing support extension 108.

Figure 2:
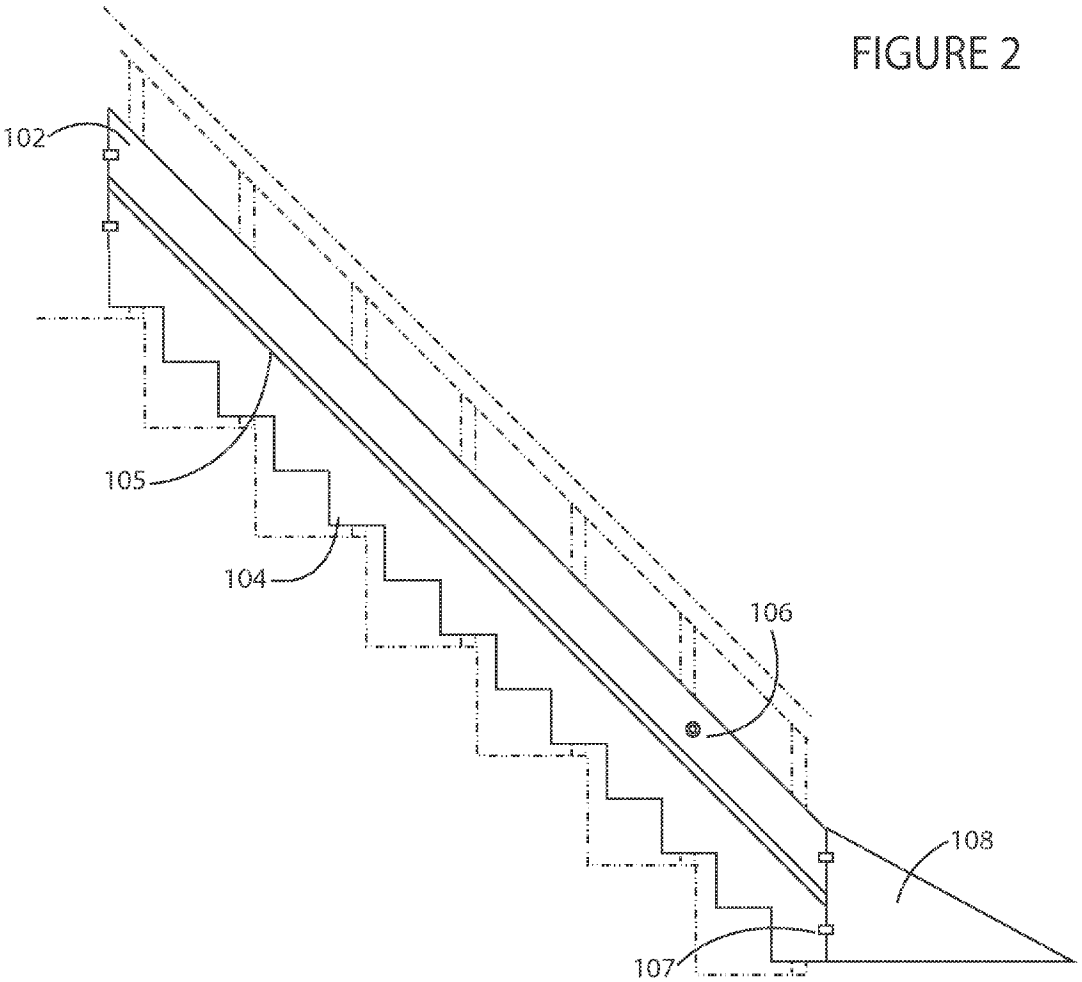
FIG. 2 shows a side-view of the inflatable staircase slide assembly according to one or more embodiments of the invention.

FIG. 2 illustrates a side-view of the inflatable staircase slide assembly with the elongate strap 105, provided on one sidewall 102 of the two sidewalls, extending between the distal edge and the proximal edge of the inflatable tubular half-pipe slide member. In one or more embodiments, each of the elongate straps 105 may be embedded with each of the two sidewalls 102, respectively, or alternatively may extend out of the surface of each of the two sidewalls 102. According to at least one embodiment of the invention, as shown in FIG. 2, the compressible support layer 104 is saw-toothed shaped with a plurality of teeth, with each tooth of the plurality of teeth having a horizontal width and a vertical length. Using the plurality of teeth, the support layer 104 is able to engage the staircase at each step of the staircase. In one or more embodiments, each horizontal width of each of the plurality of teeth is shorter than each step of the staircase, such that at least one tooth of the plurality of teeth engages the staircase at each step as shown in the figure. In one embodiment, more than one tooth of the plurality of teeth engages each step, such that for example two, three, or more teeth engage a single step of the plurality of steps of the staircase.

According to one or more embodiments of the invention, and as shown in FIG. 2, the inflatable tubular half-pipe slide member includes a plurality of connectors 107 on each of the two sidewalls, in order to couple the inflatable slide assembly 100 to one or more additional inflatable slide assemblies. The connectors 107 are provided on one or more of the top portion and the bottom portion of the inflatable tubular half-pipe slide member. As such, multiple inflatable slide assemblies can be connected to one another to increase the total length of the slide and accommodate different types of staircases with different number of steps. In at least one embodiment, the connectors 107 are interchangeable and replaceable to hold different slide assemblies of different shapes and sizes. Using the one or more connectors 107, a user is able to use the inflatable slide assembly 100 at different locations and different staircases by inflating and deflating the assembly, as well as connecting and disconnecting multiple inflatable slide assemblies from either or both of the top portion of the assembly and the bottom portion of the assembly depending on the user's needs.

Inflating and deflating the inflatable slide assembly occurs by way of at least one blow-up valve 106 oriented on the inflatable tubular half-pipe slide member and/or the compressible support layer 104. In one or more embodiments, one blow-up valve 106 is included to inflate and deflate both the inflatable tubular half-pipe slide member and the compressible support layer 104 (when the compressible support layer is inflatable), or by separate blow-up valves (not shown) for each of the inflatable tubular half-pipe slide member and the compressible support layer 104 (when the compressible support layer is inflatable). As such, the inflatable slide assembly 100 is easily transported from one location to another, such as from indoors to outdoors and vice versa by way of the compressible and inflatable configurations.

FIG. 2 also illustrates an optional landing support extension 108 provided at the bottom portion of the inflatable tubular half-pipe slide member according to one or more embodiments of the invention. As shown, and in at least one embodiment, the landing support extension 108 angles away from the inflatable tubular half-pipe slide member, as opposed to the in-line embodiment of landing support extension 108 shown in FIG. 1. Any angle may be utilized as one skilled in the art will recognize. The landing support extension may include a flat bottom or angle bottom, and may be of any shape or size. By way of one or more embodiments, the landing support extension 108 includes extension couplers (not shown) allowing a user to attach and detach the landing support extension to different inflatable slide assemblies, for example when multiple inflatable slide assemblies are connected to one another using the connectors 107 as explained above. The extension couplers (not shown) may attach directly to the inflatable tubular half-pipe slide member using the extension couplers. Alternatively or in addition to, the landing support extension 108 may couple to the connectors 107 on the bottom portion of the inflatable tubular half-pipe slide member to connect the landing support extension 108 to the inflatable tubular half-pipe slide member.

According to one or more embodiments, the inflatable staircase slide assembly 100 lacks direct support between the compressible support layer 104 and the steps of the staircase, for example by having a space between one or more steps and the compressible support layer 104. The lack of direct support provides a braking effect to the user acting on the slide for added support and security.

Figure 3:
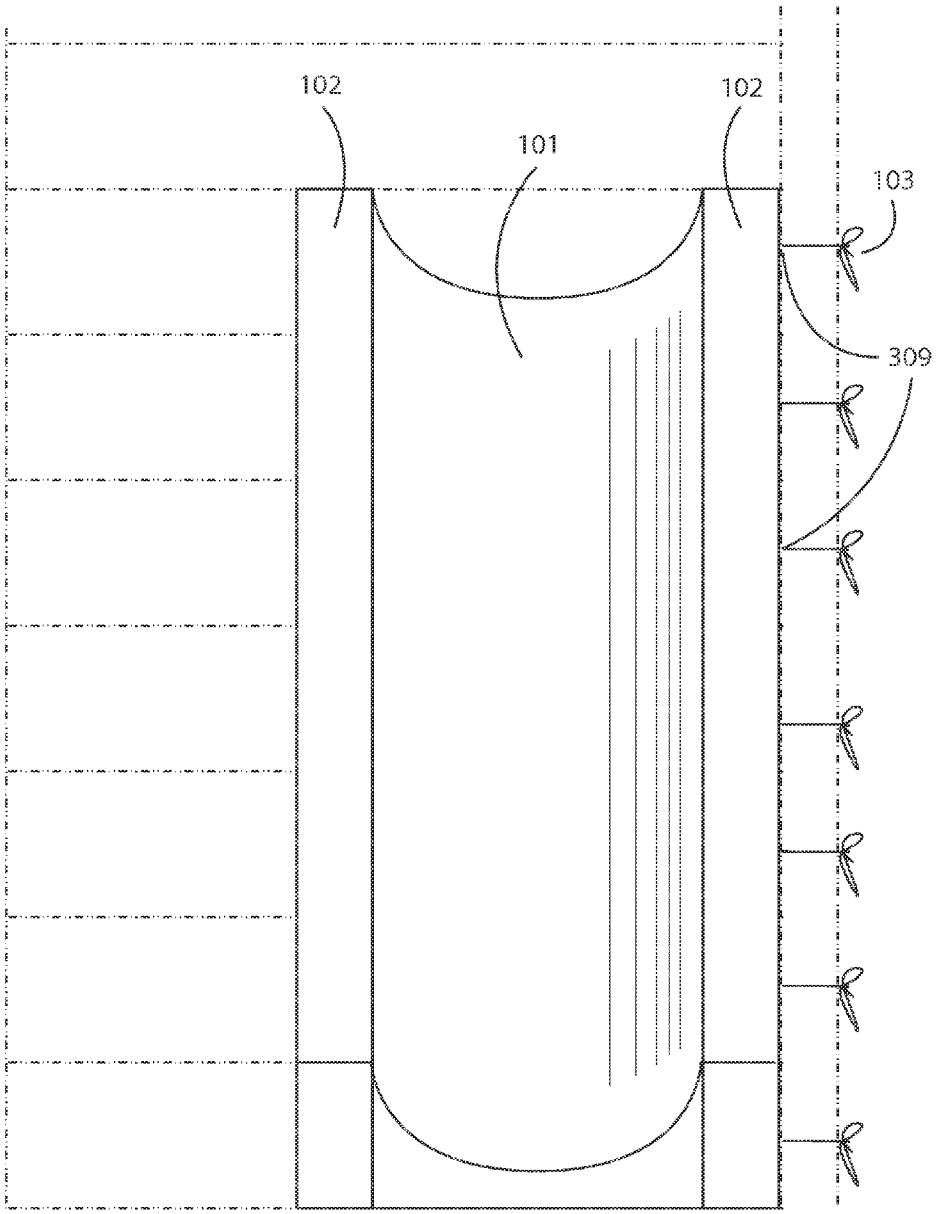
FIG. 3 shows a front view of the inflatable staircase slide assembly according to one or more embodiments of the invention.

FIG. 3 shows a front view of the inflatable staircase slide assembly, and specifically the inflatable tubular half-pipe slide member with the elongated dipped surface 101, the two sidewalls 102, and ties 103. The ties 103 may be permanently attached to each of the elongate straps 105, or may be interchangeable to accommodate to different side rails and to maintain the durability of the ties. Also shown in FIG. 3, according to at least one embodiment of the invention, are a plurality of engagement points 309 located on each elongate strap. FIG. 3 shows the plurality of engagement points 309 on a first sidewall of the two sidewalls, however engagements points are provided on both sidewalls on each elongate strap respectively. By way one or more embodiments, each engagement point 309 on at least one of the straps contains the plurality of ties 103 (if the ties are permanently attached to each elongate strap), or connects to the plurality of ties 103 (if the ties are interchangeable), allowing a user to tie the inflatable tubular half-pipe slide member to the side rails at multiple locations for added safety and security. In one or more embodiments, the ties may be implemented with a hook and loop material, for example VELCRO®.

As shown in FIG. 3, and according to at least one embodiment of the invention, the inflatable staircase slide assembly 100 includes a width extending between the two sidewalls 102 of the inflatable tubular half-pipe slide member, such that the width is less than the width of the whole staircase. This enables a space to be provided around a second sidewall of the two sidewalls (the second sidewall being the sidewall not containing ties 103 in FIG. 3), such that only one sidewall of the two sidewalls engages the side rails at a time. This allows for users to use the staircase via the space provided around the second sidewall and use the inflatable staircase slide assembly located beside the space.

In one or more embodiments, to provide for better engagement between the inflatable staircase slide assembly 100 and the staircase, the compressible support layer 104 includes a friction element (not shown) provided on alternating teeth, all teeth or selected teeth of the plurality of teeth in order to engage with alternating steps, every step, or selected steps of the staircase. According to at least one embodiment of the invention, the friction element comprises one or more of a hook and loop material, such as VELCRO®, and rubber. Alternatively or in addition to the friction element, for better engagement between the inflatable staircase slide assembly 100 and the staircase, the inflatable slide assembly 100 may include at least one sucker (not shown). In at least one embodiment, the at least one sucker is provided on each horizontal width of the plurality of teeth, on each vertical length of the plurality of teeth, at the bottom portion of the inflatable tubular half-pipe slide member, at the top portion of the inflatable tubular half-pipe slide member or any combination thereof.

In one or more embodiments, the compressible support layer 104 is made of a material selected from rubber, foam, sponge, any compressible material or any combination thereof. Furthermore, in one or more embodiments, the inflatable tubular half-pipe slide member may entirely or partially contain vinyl.

By way of one or more embodiments of the invention, the inflatable slide assembly is a portable assembly allowing a user to transport the assembly. For example, in at least one embodiment, the user is able to transport the assembly using the engagement points 309 of the elongate strap 105.

Figure 4:
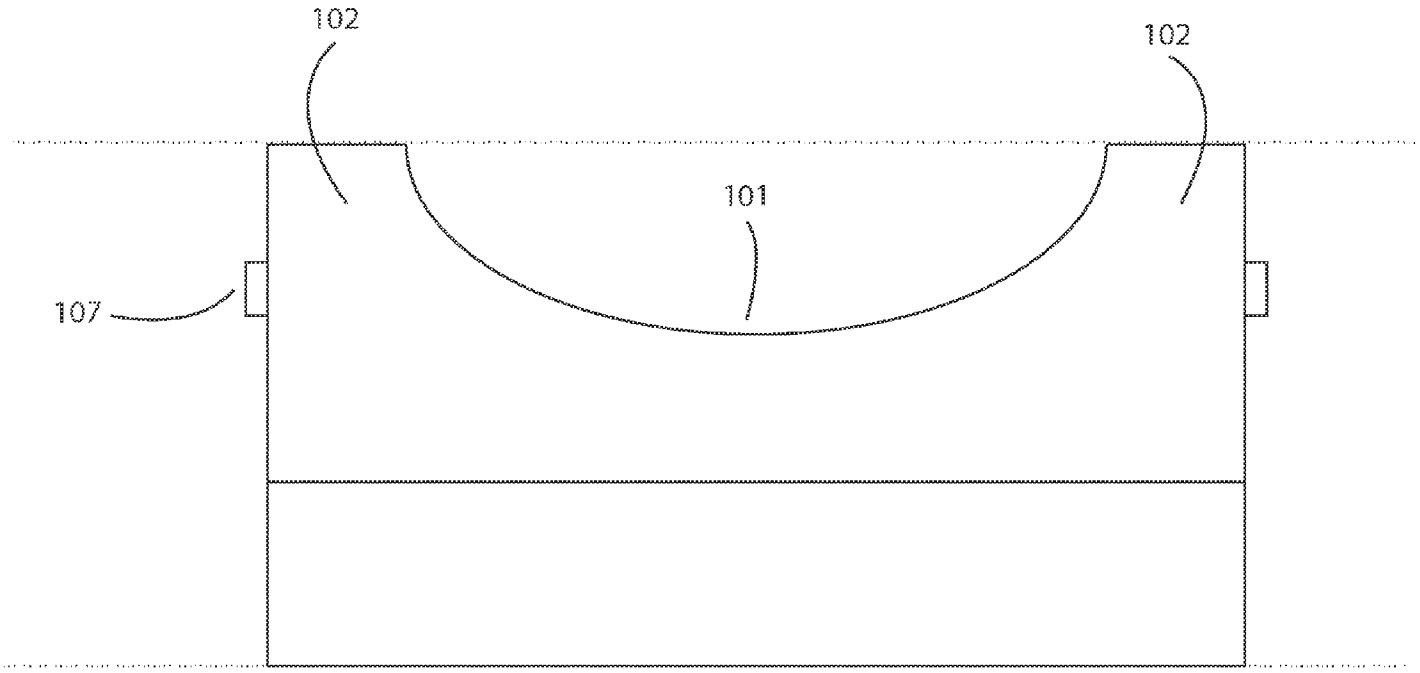
FIG. 4 shows an end view of the inflatable staircase slide assembly from the bottom portion or the top portion according to one or more embodiments of the invention.

FIG. 4 shows a front view of the inflatable staircase slide assembly from the bottom portion or the top portion. Specifically, FIG. 4 illustrates the elongated dipped surface 101, the two sidewalls 102 and connectors 107. As shown, the two sidewalls 102 rise above the elongated dipped surface 101, creating the inflatable tubular half-pipe slide member. Although the connectors 107 are shown as being on the sides of the tubular half-pipe slide member, the connectors 107 may be placed on a front surface, back surface, top surface or bottom surface of the tubular half-pipe slide member on or near the bottom portion, top portion and/or intermediate portion of the tubular half-pipe slide member. In one or more embodiments, the dimensions of each of the two sidewalls are equal, or alternatively may consist of different dimensions.

While the invention herein disclosed has been described by means of specific embodiments and applications thereof, numerous modifications and variations could be made thereto by those skilled in the art without departing from the scope of the invention set forth in the claims.

What is claimed is:

1. An inflatable slide assembly configured to engage with a staircase and side rails, wherein said staircase comprises a length and a width, comprising: an inflatable tubular half-pipe slide member configured to be placed over said staircase at an incline comprising a top portion and a bottom portion, an elongated dipped surface with a distal edge on said top portion, a proximal edge on said bottom portion, and a tubular intermediate section extending lengthwise between said distal edge and said proximal edge across said length of said staircase, two sidewalls extending lengthwise from said distal edge on said top portion to said proximal edge on said bottom portion and oriented on either side of said elongated dipped surface, such that each of said two sidewalls rise above said elongated dipped surface; a compressible support layer underlying said inflatable tubular half-pipe slide member configured to be placed over said staircase and engage said staircase; a plurality of engagement points provided on a first sidewall of said two sidewalls configured to attach said inflatable tubular half-pipe slide member to said side rails; and, at least one blow-up valve oriented on one or more of said inflatable tubular half-pipe slide member and said compressible support layer, and configured to allow a user to inflate said inflatable tubular half-pipe slide member and said compressible support layer; wherein said compressible support layer is saw-toothed shaped comprising a plurality of teeth, wherein each of said plurality of teeth comprise a horizontal width and a vertical length such that said support layer is configured to engage said staircase at each step of said staircase; and wherein said compressible support layer comprises a friction element provided on alternating teeth of said plurality of teeth configured to engage with alternating steps of said staircase.

2. The inflatable slide assembly of claim 1, wherein each horizontal width of said plurality of teeth is shorter than each step on said staircase, such that at least one tooth of said plurality of teeth is configured to engage said staircase at each step.

3. The inflatable slide assembly of claim 1, wherein said inflatable tubular half-pipe slide member and said compressible support layer are a single element.

4. The inflatable side assembly of claim 1, further comprising an elongate strap provided on each of said two sidewalls extending between said distal edge and said proximal edge.

5. The inflatable slide assembly of claim 4, wherein each of said plurality of engagement points are located on said elongate strap and comprise a plurality of ties to tie said inflatable tubular half-pipe slide member to said side rails.

6. The inflatable slide assembly of claim 1, wherein said inflatable tubular half-pipe slide member further comprises a plurality of connectors on each of said two sidewalls configured to couple said inflatable slide assembly to one or more additional inflatable slide assemblies.

7. The inflatable slide assembly of claim 6, wherein said plurality of connectors on each of said two sidewalls comprise one or more connectors on said top portion and one or more connectors on said bottom portion.

8. The inflatable slide assembly of claim 1, further comprising at least one coupling element at said bottom portion of said inflatable tubular half-pipe slide member configured to provide a horizontal displacement to said inflatable slide assembly with respect to said staircase.

9. The inflatable slide assembly of claim 8, wherein said at least one coupling element is interchangeable configured to accommodate to different staircase surfaces.

10. The inflatable slide assembly of claim 1, further comprising a landing support extension provided at said bottom portion of said inflatable tubular half-pipe slide member.

11. The inflatable slide assembly of claim 10, wherein said landing support extension angles away from said inflatable tubular half-pipe slide member.

12. The inflatable slide assembly of claim 1, wherein said friction element comprises one or more of a hook and loop material and rubber.

13. The inflatable slide assembly of claim 1, further comprising at least one sucker configured to engage with said staircase, wherein said at least one sucker is provided on said each horizontal width of said plurality of teeth, on said each vertical length of said plurality of teeth, at said bottom portion of said inflatable tubular half-pipe slide member, at the top portion of the said inflatable tubular half-pipe slide member or any combination thereof.

14. The inflatable slide assembly of claim 1, wherein said compressible support layer comprises a material selected from rubber, foam, sponge or any combination thereof.

15. The inflatable slide assembly of claim 1, wherein said inflatable tubular half-pipe slide member comprises vinyl.

16. The inflatable slide assembly of claim 1, wherein said inflatable slide assembly is a portable assembly configured to be transported.

17. The inflatable slide assembly of claim 1, wherein said inflatable slide assembly is a portable assembly configured to be transported via said engagement points.

18. The inflatable slide assembly of claim 1, further comprising a width extending between said two sidewalls, wherein said width is less than said staircase width such that a space is provided around a second sidewall of said two sidewalls and only one sidewall of said two sidewalls engages said side rails at a time.

* * * * *